US007814595B2

(12) United States Patent
Kafzan

(10) Patent No.: US 7,814,595 B2
(45) Date of Patent: Oct. 19, 2010

(54) TOWEL PRESENTING AND WASHING MACHINE AND A METHOD FOR OPERATING SAME

(75) Inventor: Abraham Kafzan, Tel-Aviv (IL)

(73) Assignee: Ultra Clean Ltd., Tel-Aviv (IL)

( * ) Notice: Subject to any disclaimer, the term of this patent is extended or adjusted under 35 U.S.C. 154(b) by 897 days.

(21) Appl. No.: 10/595,661

(22) PCT Filed: Nov. 2, 2004

(86) PCT No.: PCT/IL2004/001000

§ 371 (c)(1),
(2), (4) Date: Mar. 5, 2007

(87) PCT Pub. No.: WO2005/041735

PCT Pub. Date: May 12, 2005

(65) Prior Publication Data

US 2007/0199158 A1 Aug. 30, 2007

(30) Foreign Application Priority Data

Nov. 3, 2003 (IL) ..... 158727

(51) Int. Cl.
*D06B 3/20* (2006.01)

(52) U.S. Cl. ..... 8/151; 8/158; 8/159; 8/147; 68/23 R; 68/97; 68/17 R; 68/13 R; 68/94; 312/34.11; 312/34.12; 312/34.13; 312/34.15; 312/34.17; 134/18

(58) Field of Classification Search ..... 8/15, 8/151, 159; 68/17 R, 23 R, 97
See application file for complete search history.

(56) References Cited

U.S. PATENT DOCUMENTS

| | | | | |
|---|---|---|---|---|
| 2,295,955 | A * | 9/1942 | La Page | 38/2 |
| 2,367,200 | A * | 1/1945 | Cooper | 312/34.13 |
| 3,215,481 | A * | 11/1965 | Kobi | 312/34.15 |
| 3,574,431 | A * | 4/1971 | Henderson | 312/34.13 |
| 3,728,001 | A * | 4/1973 | Bahnsen | 312/34.11 |

(Continued)

OTHER PUBLICATIONS

PCT Search Report dated Jan. 24, 2005 of Patent Application No. PCT/IL2004/001000 filed Nov. 2, 2004.

*Primary Examiner*—Michael Komakov
*Assistant Examiner*—Katelyn B Whatley
(74) *Attorney, Agent, or Firm*—Vern Maine & Associates

(57) ABSTRACT

There is provided a towel presenting, washing and drying machine, including first and second spaced-apart rollers each rotatable in a clock-wise and counter-clockwise sense; a bath having liquid inlet and outlet ports located between the rollers supporting a plurality of rod members for guiding a towel section in a meandering fashion in the bath; means for cleaning the towel section in the bath; at least one drying drum disposed outside the bath between the rollers, at least one motor and transmission means coupled to the rollers and the drying drum, and a controller for timely selectively operating each of the rollers and the drying drum. A method for automatically presenting a clean towel section for drying purposes and for washing and drying soiled towel sections in a towel presenting and washing machine, is also provided.

18 Claims, 16 Drawing Sheets

U.S. PATENT DOCUMENTS

| | | | | | |
|---|---|---|---|---|---|
| 3,843,219 | A | * | 10/1974 | Cassia | 312/34.11 |
| 3,858,952 | A | * | 1/1975 | Bahnsen | 312/34.13 |
| 4,104,814 | A | | 8/1978 | Whight | |
| 4,297,859 | A | | 11/1981 | Geschka et al. | |
| 4,350,028 | A | | 9/1982 | Geschka | |
| 4,676,559 | A | * | 6/1987 | Hood et al. | 312/34.11 |
| 4,718,588 | A | * | 1/1988 | Arabian et al. | 226/127 |
| 4,746,907 | A | * | 5/1988 | Zehnder, Jr. | 340/525 |
| 4,826,262 | A | * | 5/1989 | Hartman et al. | 312/34.12 |
| 4,999,611 | A | * | 3/1991 | Zehnder, Jr. | 340/675 |
| 5,184,885 | A | * | 2/1993 | Arabian et al. | 312/34.11 |
| 5,244,263 | A | * | 9/1993 | Kennedy | 312/34.11 |
| 5,375,920 | A | * | 12/1994 | Macchi Cassia | 312/34.17 |
| 5,883,022 | A | * | 3/1999 | Elsener | 442/192 |
| 6,267,460 | B1 | * | 7/2001 | Gaide et al. | 312/34.11 |
| 6,578,936 | B1 | * | 6/2003 | Darman | 312/34.11 |
| 2003/0160107 | A1 | * | 8/2003 | Harris | 239/63 |
| 2007/0199158 | A1 | * | 8/2007 | Kafzan | 8/151 |

* cited by examiner

TOWEL PRESENTING AND WASHING MACHINE AND A METHOD FOR OPERATING SAME

FIELD OF THE INVENTION

The present invention relates to an automatic towel dispenser and more particularly to an automatic towel presenting, washing and drying machine and to a method for operating same.

BACKGROUND OF THE INVENTION

There exist a multiplicity of systems for drying hands after washing, the main systems being as follows:

- hot air hand drying machines, which require relatively strong heating elements and take a substantially long time to dry the hands;
- devices for dispensing precut paper towels or a piece of towel from a roll, which the user pulls and cuts to the length of his or her desire. This device necessitates the installment of a wastebasket for the frequent collection and eventual disposal of the used towels. Constant attendance to the cleanliness and replacement of towels in the device is required;
- hand drying apparatus based on an endless towel web, forming a closed loop, which is manually actuated by the user, in order to present a length of a towel not previously used. Upon the exhaustion of the towel length, the used towel has to be replaced with a fresh one. The used towel is transported to a laundry for cleaning purposes. More sophisticated apparatus are equipped with an infrared eye for detecting the presence of a user and actuating a motor for rolling up the used length of a towel and presenting to the user a clean, unused length thereof.

Automatic towel dispensers containing towel washing and drying capabilities are also known, e.g., from U.S. Pat. Nos. 4,104,814, 4,297,859 and 4,350,028. These U.S. Patents disclose towel dispensers based on an endless towel web forming a closed loop, on a tank containing cleaning liquid having no inlets and outlets and on a unidirectional movement of the towel. Such dispensers are not effective due to unsatisfactory cleaning and drying processes, the relative large volume which they occupy, their being cumbersome, and other inherent shortcomings.

DISCLOSURE OF THE INVENTION

It is therefore a broad object of the present invention to overcome the disadvantages of the prior art automatic towel dispensers containing towel washing and drying capabilities and to provide an automatic towel presenting, washing and drying machine and method which effectively cleans the towel and presents clean towel sections for immediate use, irrespective of the time that the towel is washed and dried.

It is a further object of the present invention to provide an automatic towel presenting, washing and drying machine and method in which the cleaning action is separated into two independent stages, a first soaking and washing stage and a second rinsing and drying stage, not being performed simultaneously or being time dependent.

It is still a further object of the present invention to provide an automatic towel presenting, washing and drying machine and method having the capability of moving the towel in two directions.

Still a further object of the present invention is to provide an automatic towel presenting, washing and drying machine and method in which the soaking and washing operations and the subsequent rinsing are performed in a single chamber.

In accordance with the invention there is therefore provided a towel presenting, washing and drying machine, comprising first and second spaced-apart rollers each rotatable in a clockwise and counter-clockwise sense; a bath having liquid inlet and outlet ports located between said rollers supporting a plurality of rod members for guiding a towel section in a meandering fashion in the bath; means for cleaning the towel section in said bath; at least one drying drum disposed outside said bath between said rollers; at least one motor and transmission means coupled to said rollers and the drying drum, and a controller for timely selectively operating each of said rollers and the drying drum.

The invention further provides a method for automatically presenting a clean towel section for drying purposes and for washing and drying soiled towel sections in a towel presenting and washing machine, comprising: providing a towel dispenser having first and second rotatable rollers and a washing chamber; presenting a user with a towel section by rolling said section off said first roller by rotation in a first sense; transferring said section after use to said washing chamber containing cleaning liquid to be soaked and washed by the cleaning liquid; transferring said soaked section to said second roller by rotating it in a first sense; emptying said washing chamber from cleaning liquid and filing in rinsing liquid; selectively rotating said second roller in an opposite sense to said first sense for rinsing said towel section in the washing chamber and drying said washed and rinsed towel section while rolling it up on said second roller for further use.

BRIEF DESCRIPTION OF THE DRAWINGS

The invention will now be described in connection with certain preferred embodiments with reference to the following illustrative figures, so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a cross-sectional view of a preferred embodiment of an automatic towel presenting, washing and drying machine having its housing removed, according to the present invention;

FIG. 2 is a perspective, partially exploded view of the machine of FIG. 1;

FIG. 3 is an isometric view of the bath of the machine of FIG. 1;

FIG. 4 is an exploded view of a tensioning spiral spring unit;

FIG. 5 is an isometric exploded view of the bath shown from its bottom rear side;

FIG. 6 is an isometric view of the inside of the bath;

FIG. 7 is an isometric view of the drying drums, and

FIGS. 8A, 8B, 8C, 8D, 8E, 8F and 8G are flow diagrams illustrating the machine's operation.

DETAILED DESCRIPTION OF PREFERRED EMBODIMENTS

Figure 1:
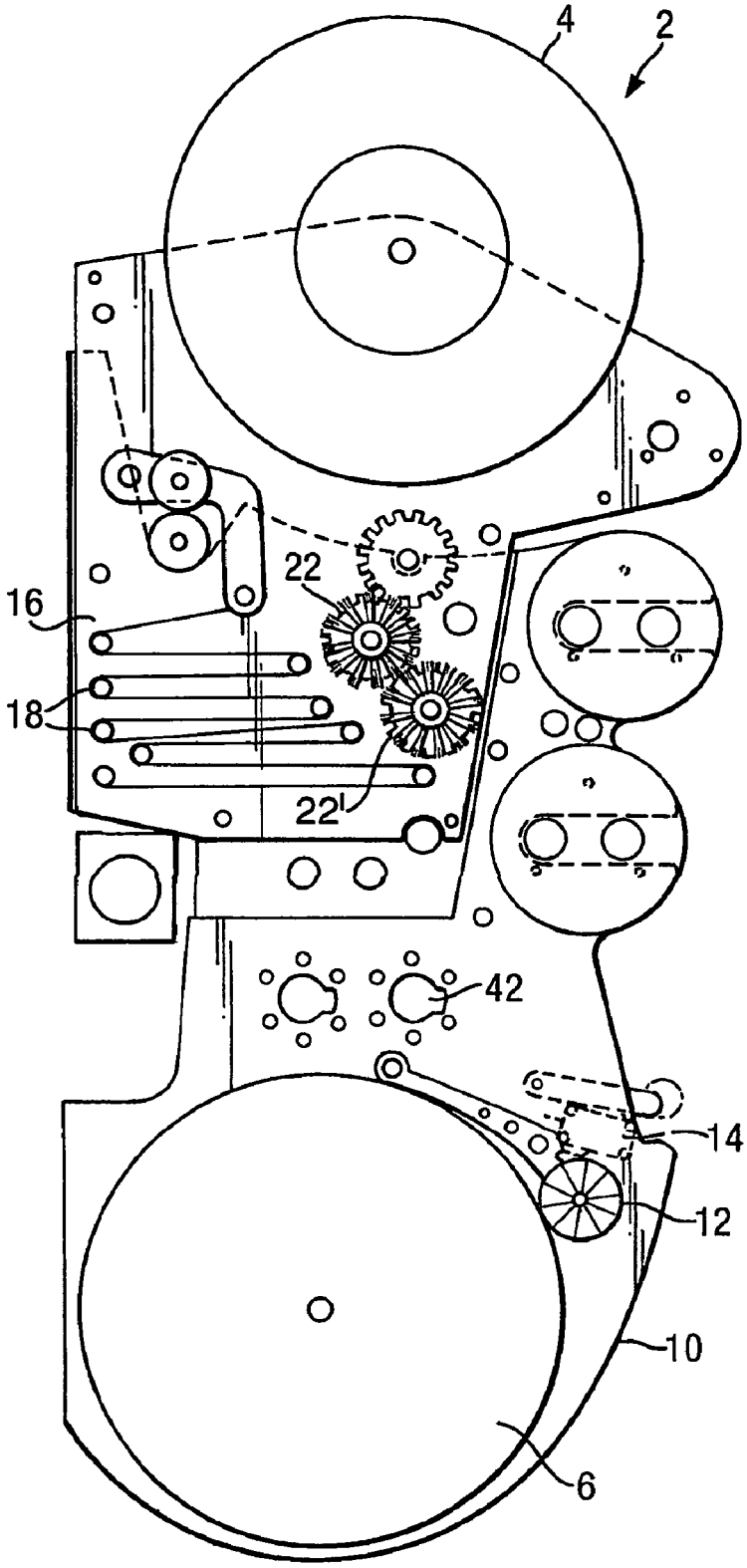
Figure 2:
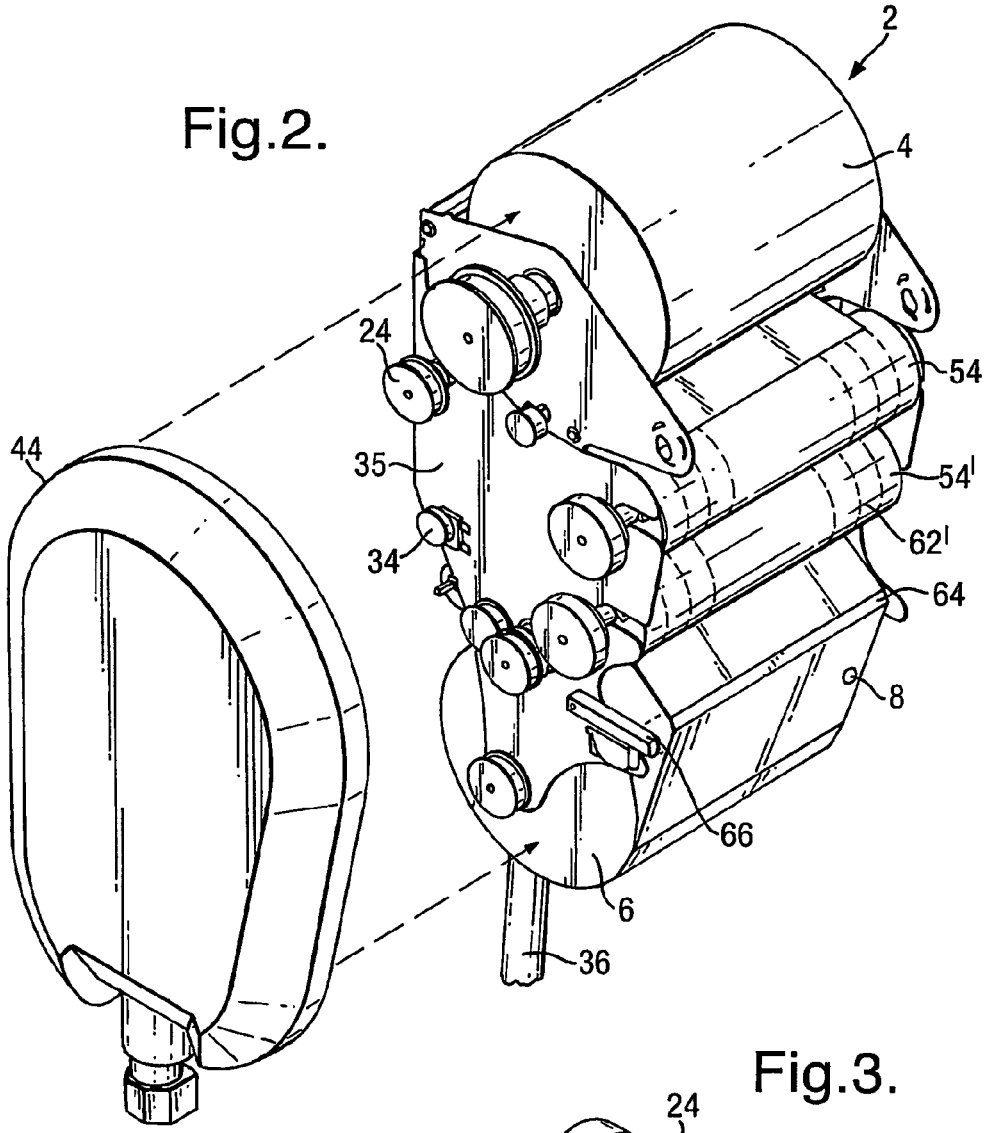
Figure 3:
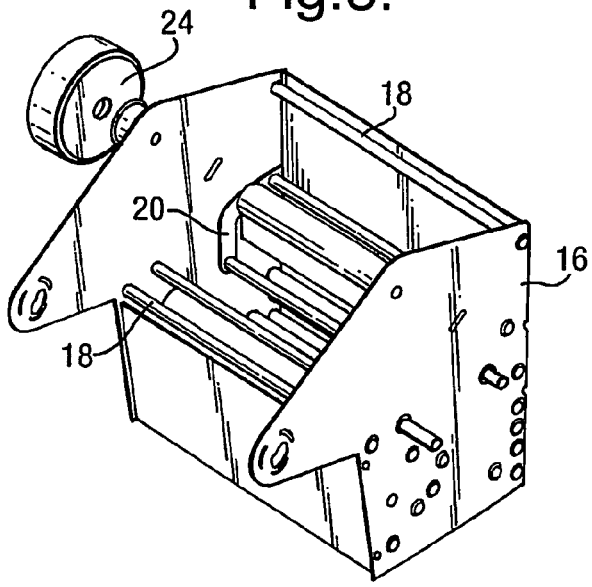
Figure 4:
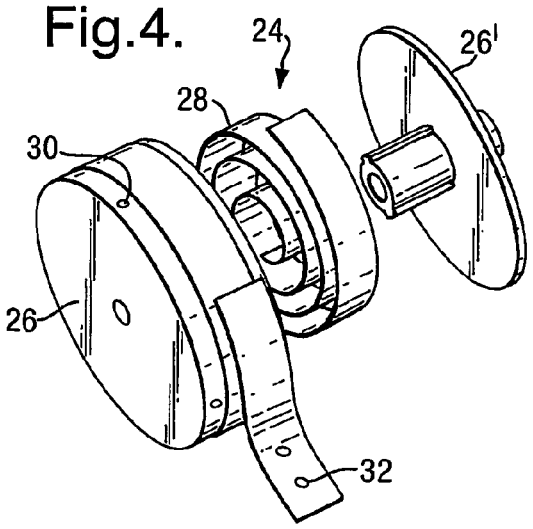
Figure 6:
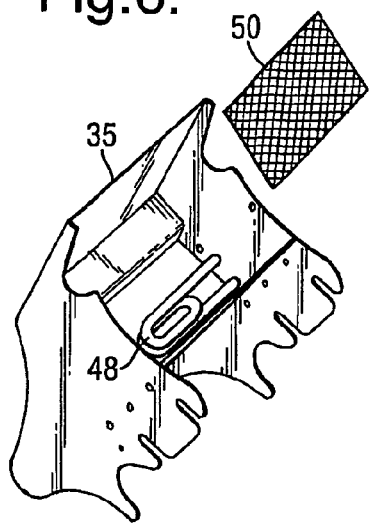

There is illustrated in FIGS. 1 and 2 the major components of the automatic towel presenting, washing and drying machine 2, having its housing removed and not shown. The machine 2 includes a used towel roller 4, a clean towel roller 6, the towel of which can be made of any suitable material which is liquid absorbable, have a predetermined width and length and which can be replaced from time to time. The movement of the towel is automatically effected by means of an electrically driven motor (not shown), coupled to the various parts of the machine by per-se known pulleys, belts and/or gears. For clarity, these coupling means are not always depicted. When a user reaches out a hand towards the machine, a sensor 8, e.g., a photoelectric sensor located at the lower portion of the machine, detects the need to use the machine, activates the motor to revolve the roller 6, in say, a counter-clockwise direction and rolls out a predetermined length of the rolled up towel 10 to be readily used. The predetermined length is measured and controlled by a measuring roller 12, operationally coupled to the roller 6 for stopping the motor action by means of a switch 14, upon the predetermined piece of towel being released from the roller 6. After use, when the user backs up from the machine and the sensor 8 no longer detects the presence of a user, the motor is reactivated to cause the roller 6 to revolve clockwise for rewinding the unused clean portion of the previously unwound web and for activating the roller 4 for collecting the used portion of the web.

Referring also to FIGS. 3 to 6 there is shown a washing and rinsing chamber or bath insert 16 supporting an arrangement of tensioning rods 18, a tensioning rocker 20 and a set of brushes 22, 22'. In addition to the above means for maintaining towel section under tension, there is also provided a spiral spring unit 24 (FIGS. 1, 3 and 4) acting on the axis of the roller 4. This arrangement assures maintaining of tension of the towel section between the rollers 4 and 6 despite variations in the diameters of the wound towel on the rollers. The spiral spring unit 24 composed of a two-part housing 26, 26' and an interposed spiral spring 28 is fitted with a north pole magnetic strip 30, complemented by a south pole magnetic strip 32 which, together with the action of the spiral spring 28 of the unit 24, retains the roller 4 in an angular position keeping the towel taut, avoiding its counter-rotation.

Upon the activation of the machine 2, the electrically operated valve 34 (FIGS. 2, 5) is opened to allow clean water from a water line to enter the bath 35 through inlet-pipe 36. The water level in the bath is set by the water level meters 38, 40. A detergent pump 42 introduces into the bath 35 a predetermined amount of detergent from the detergent container 44 (FIG. 2). Hence, during the movement of a used towel web section towards the roller 4, it passes through the bath 35, is soaked in the detergent, rubbed against by the brushes 22, 22' performing a washing action, and proceeds to be wound on the roller 4 in its wet state. It should be noted that the soaking and washing procedure takes place immediately after the use of the towel section, before the dirt has sufficient time to settle into the towel and dry, thus greatly improving the cleaning capability of the machine. The amount of detergent, hence the concentration thereof in the bath 35, is kept at a constant level in consideration of many factors, including the amount of replenishing water, the type of user, namely, whether the hands of the majority of the users are greasy or otherwise very dirty, or merely wet after regular soaping and washing.

Figure 5:
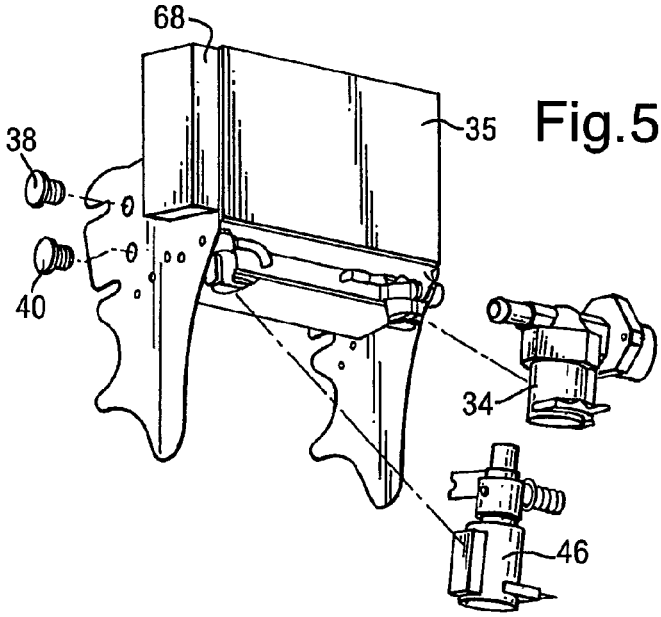
Figure 7:
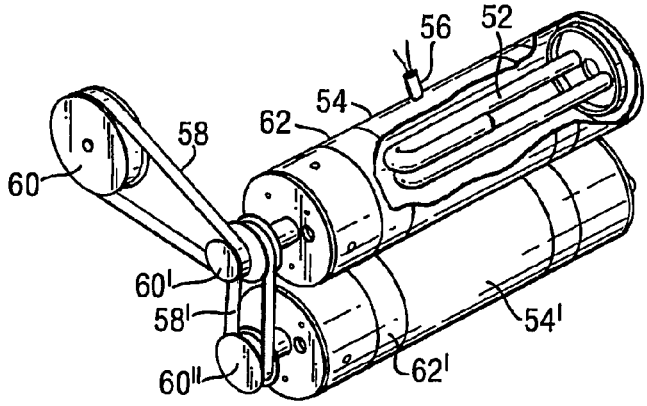
Figure 8A:
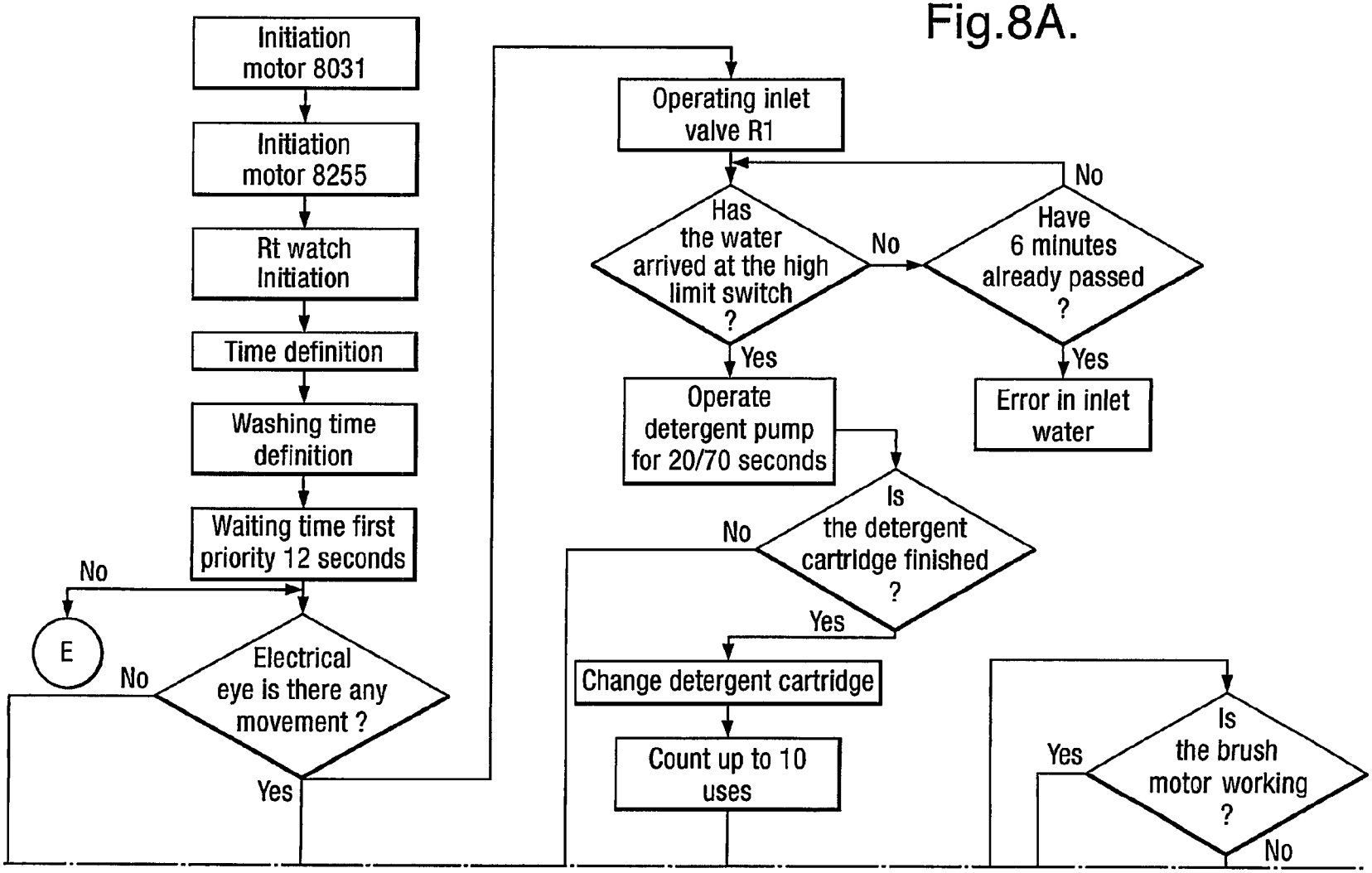
Figure 8A:
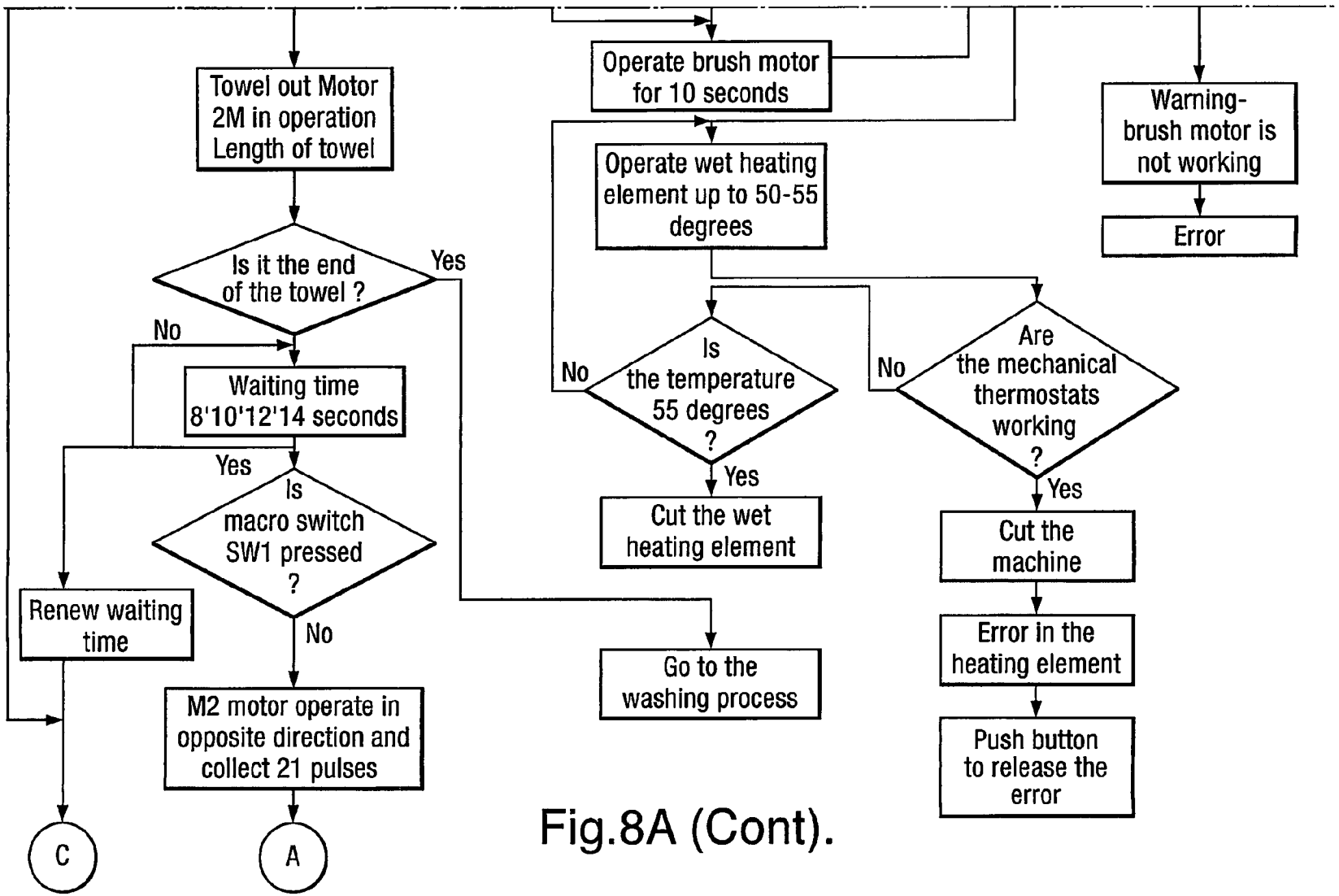
Figure 8B:
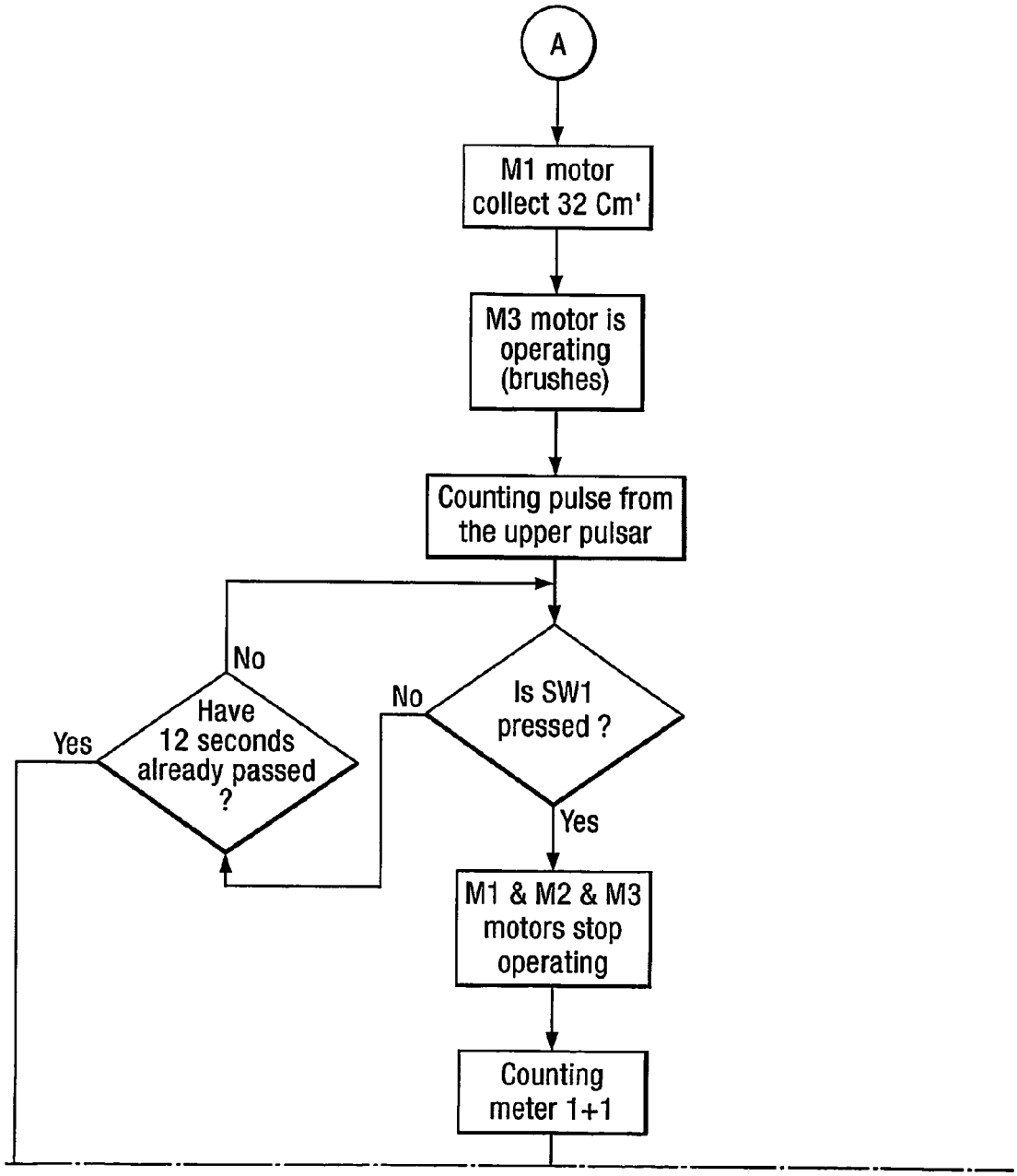
Figure 8B:
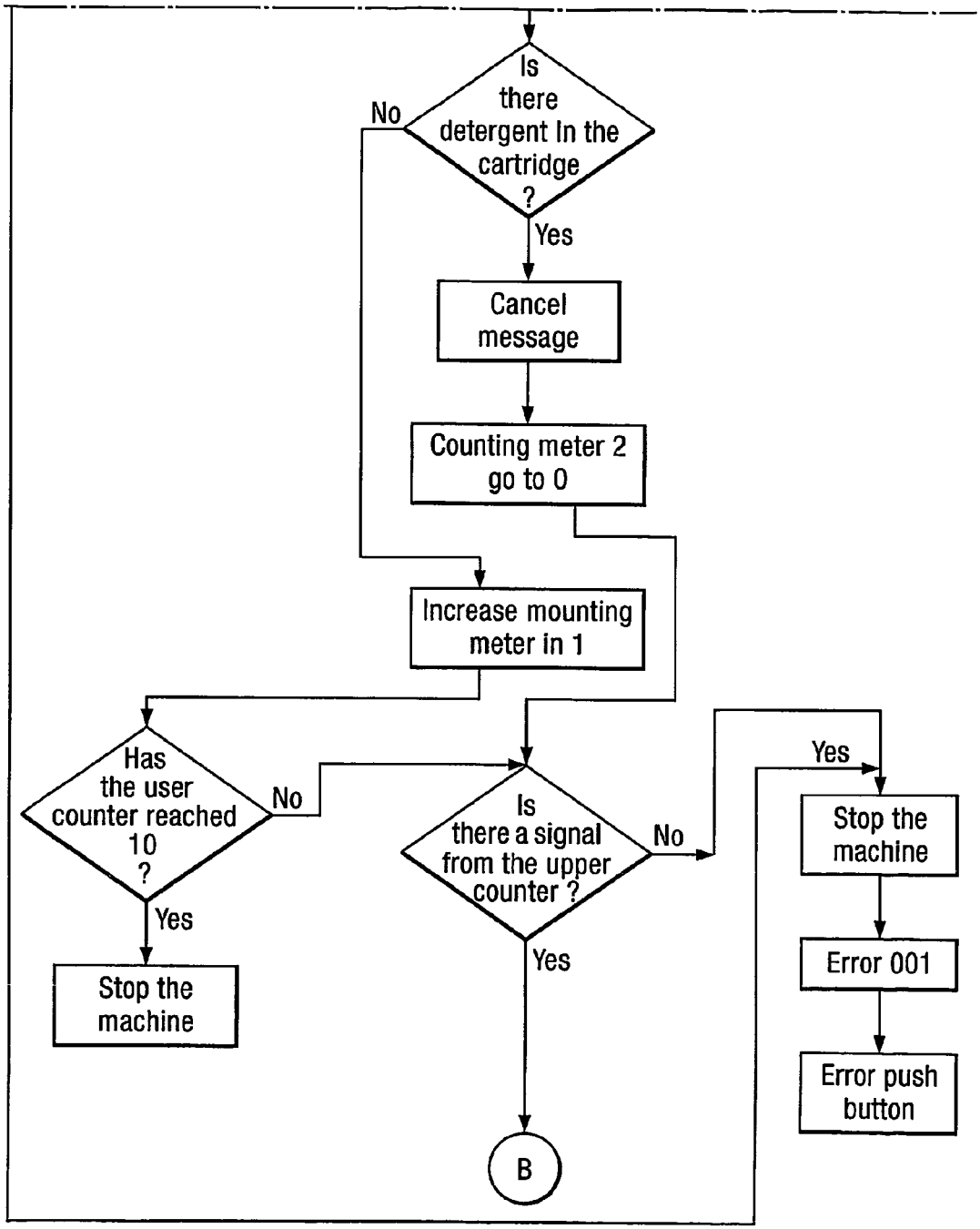
Figure 8C:
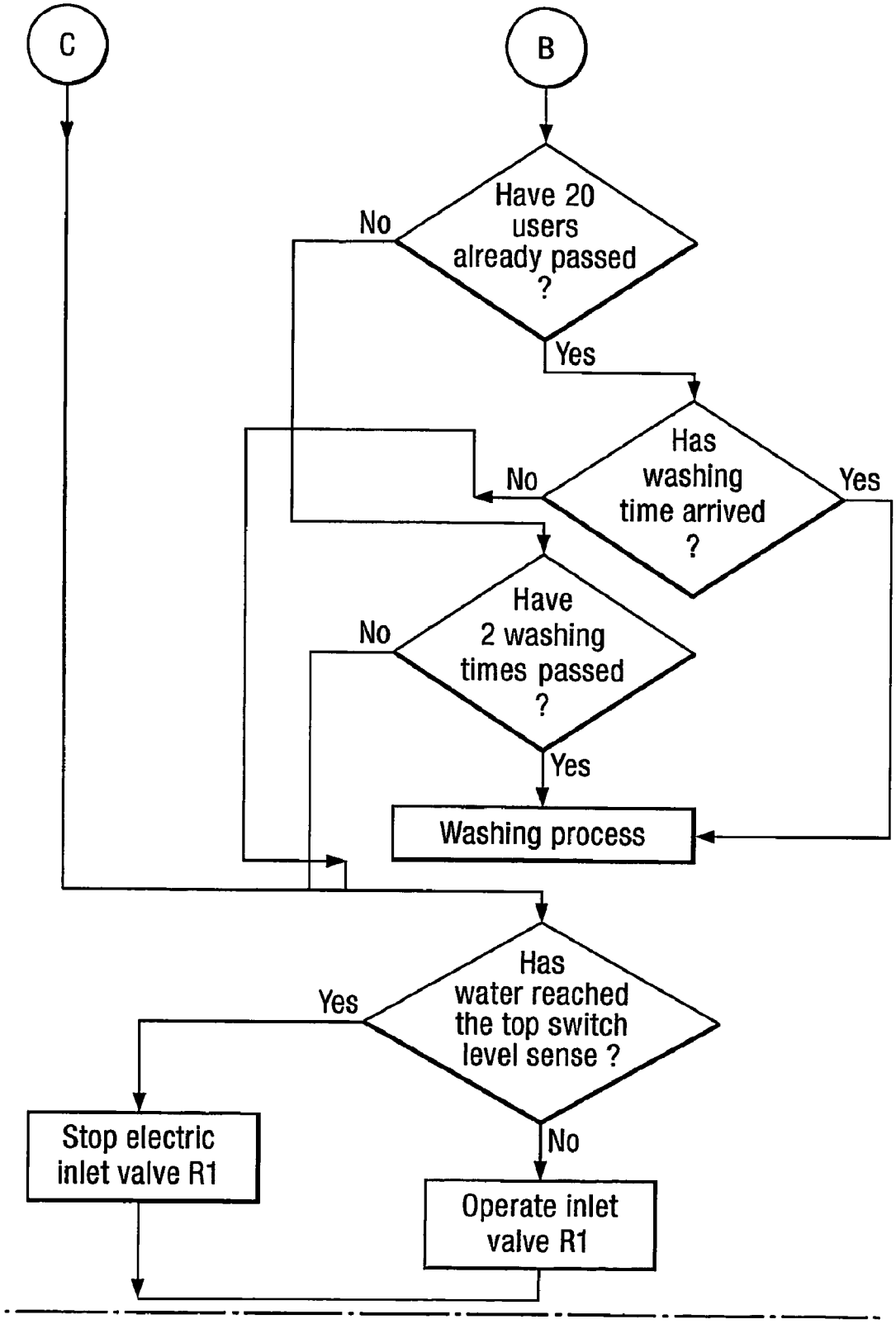
Figure 8C:
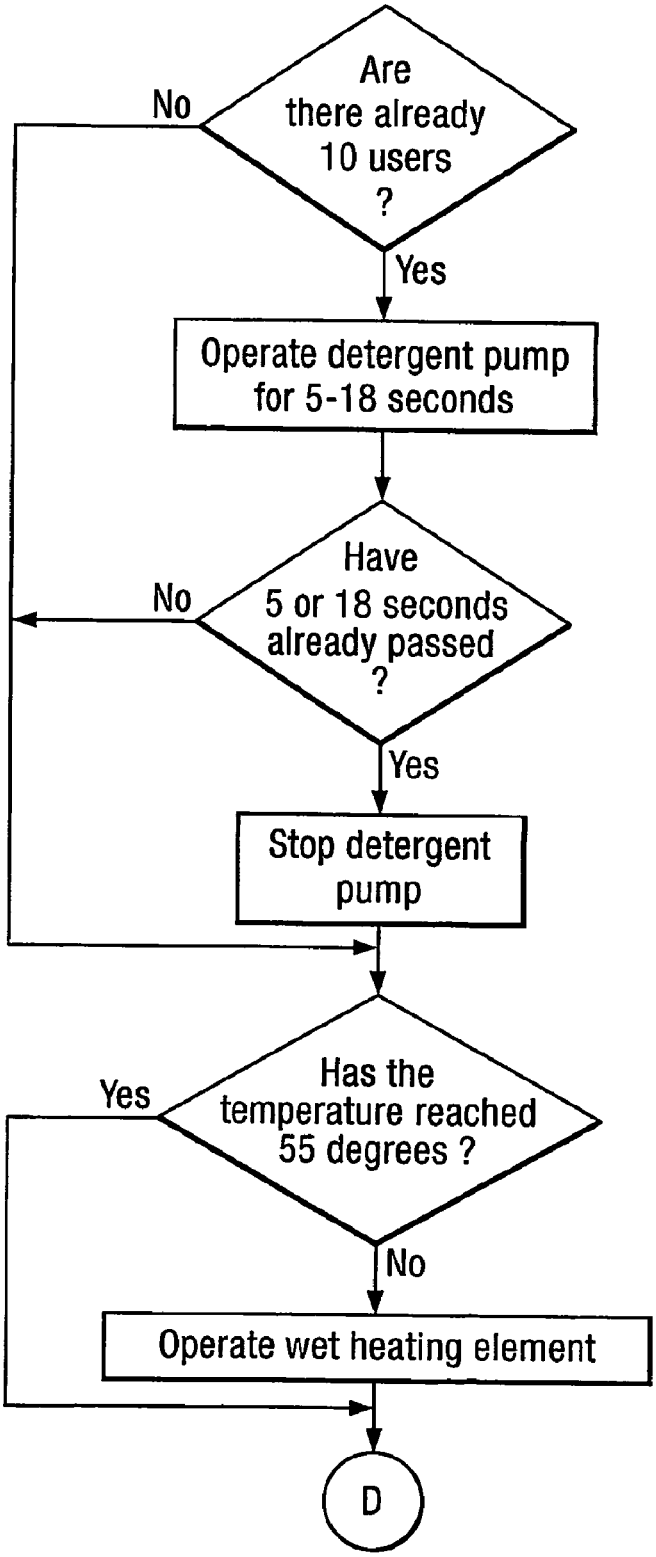
Figure 8D:
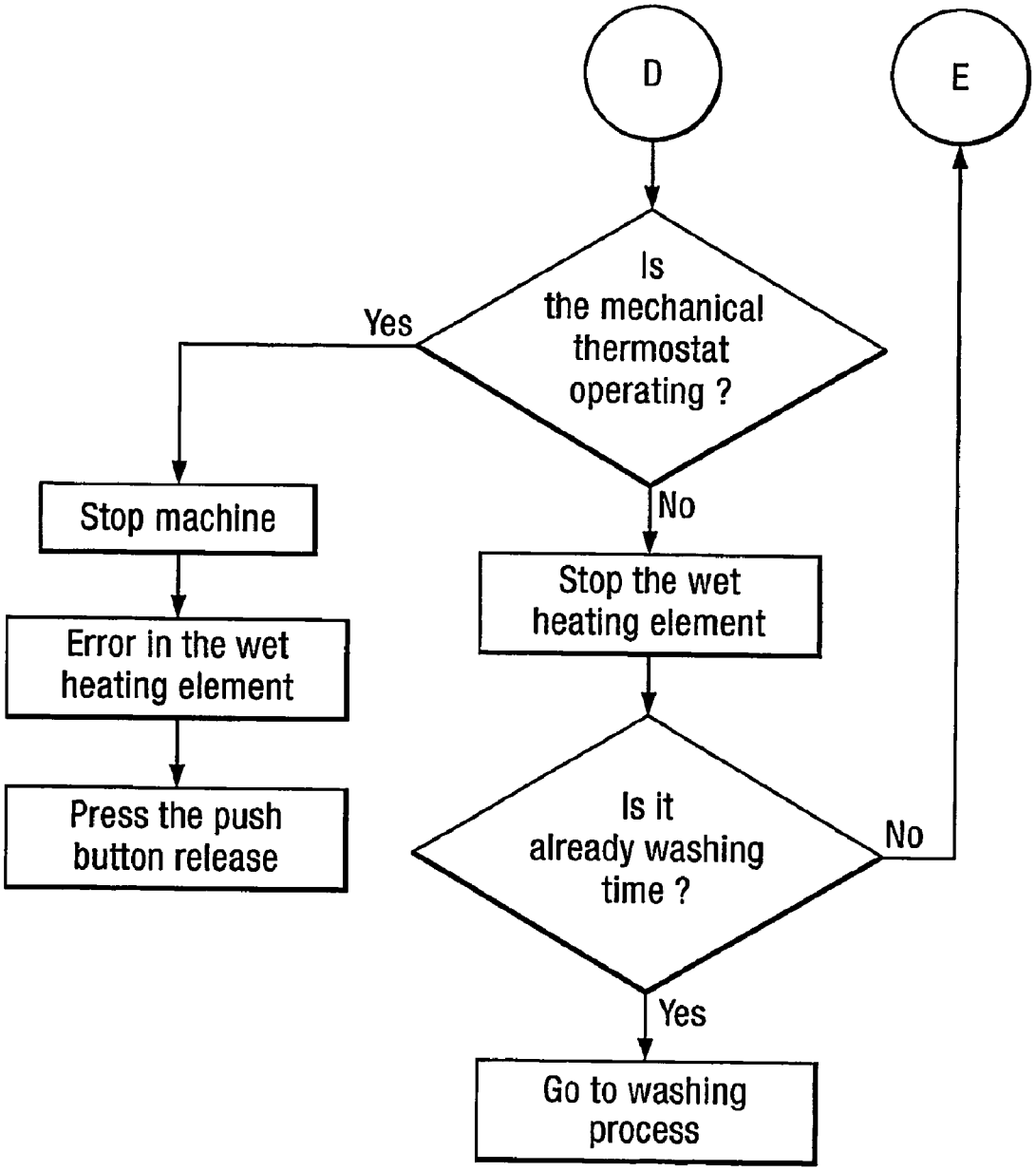
Figure 8E:
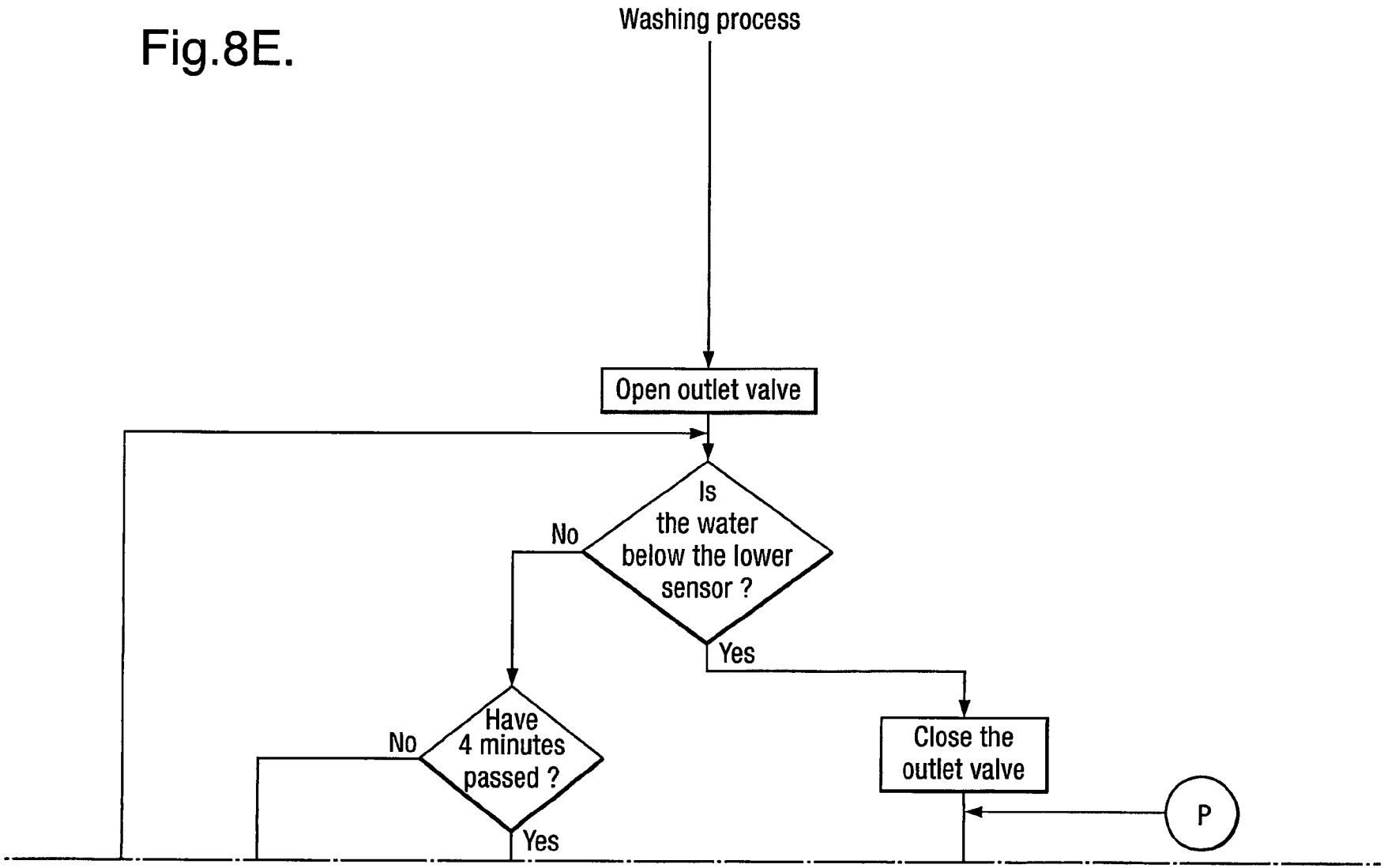
Figure 8E:
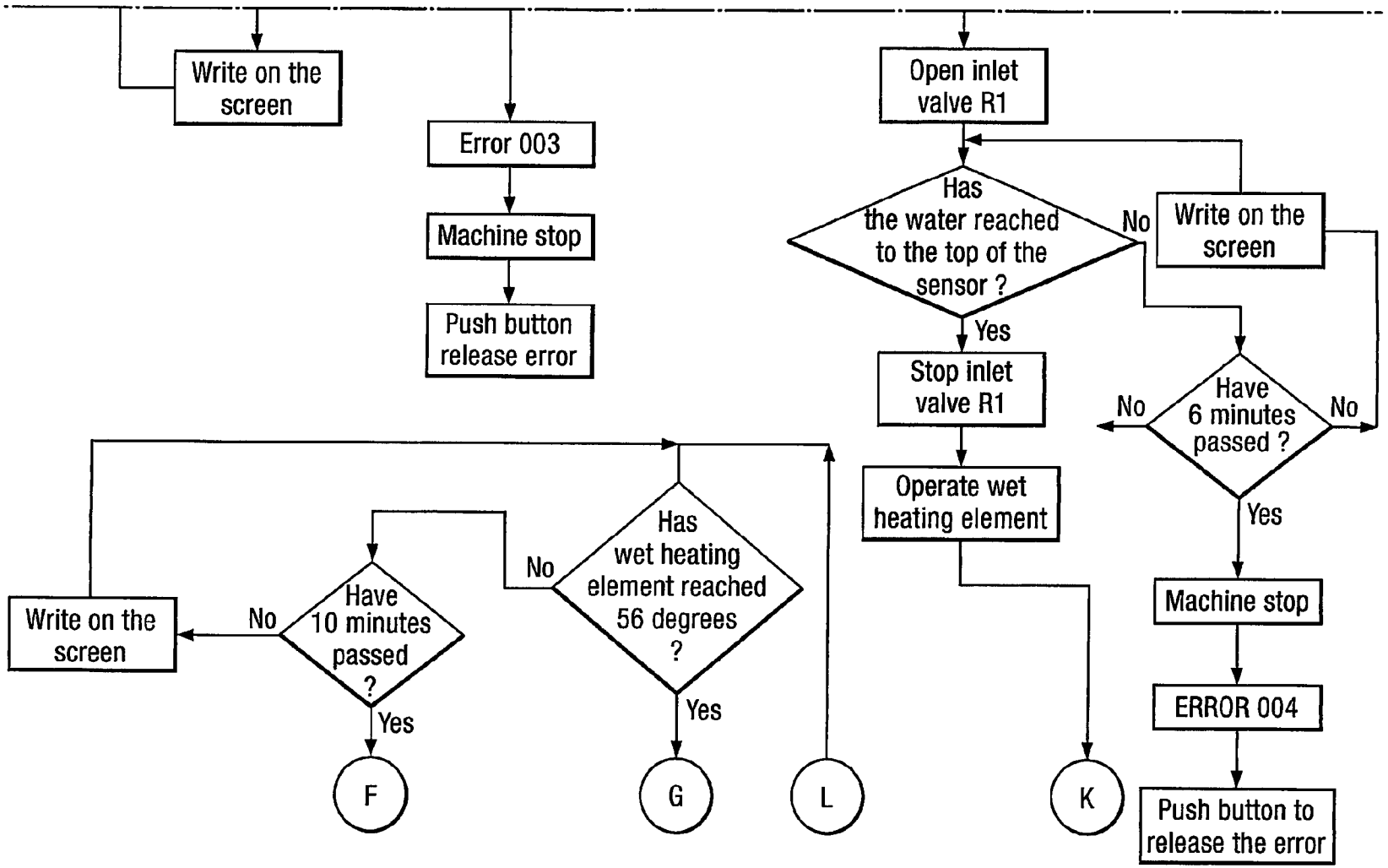
Figure 8F:
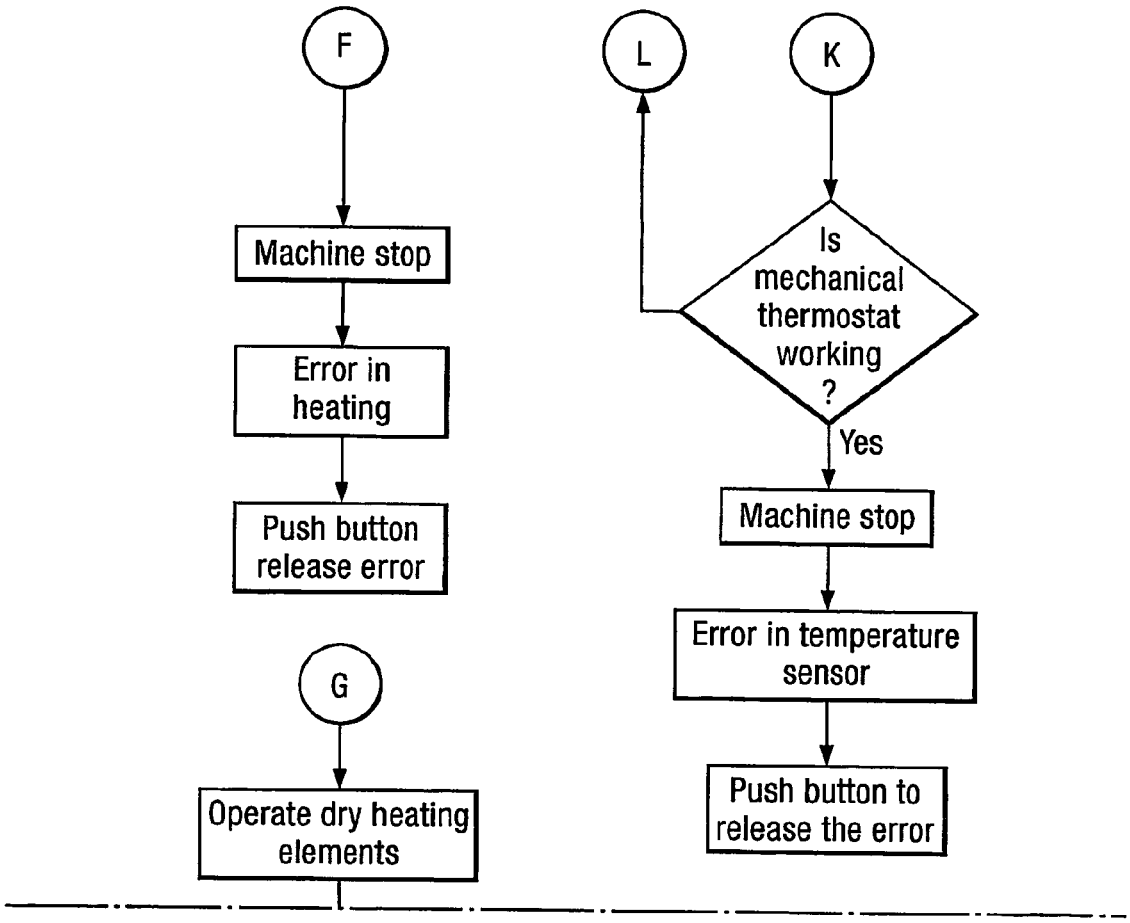
Figure 8F:
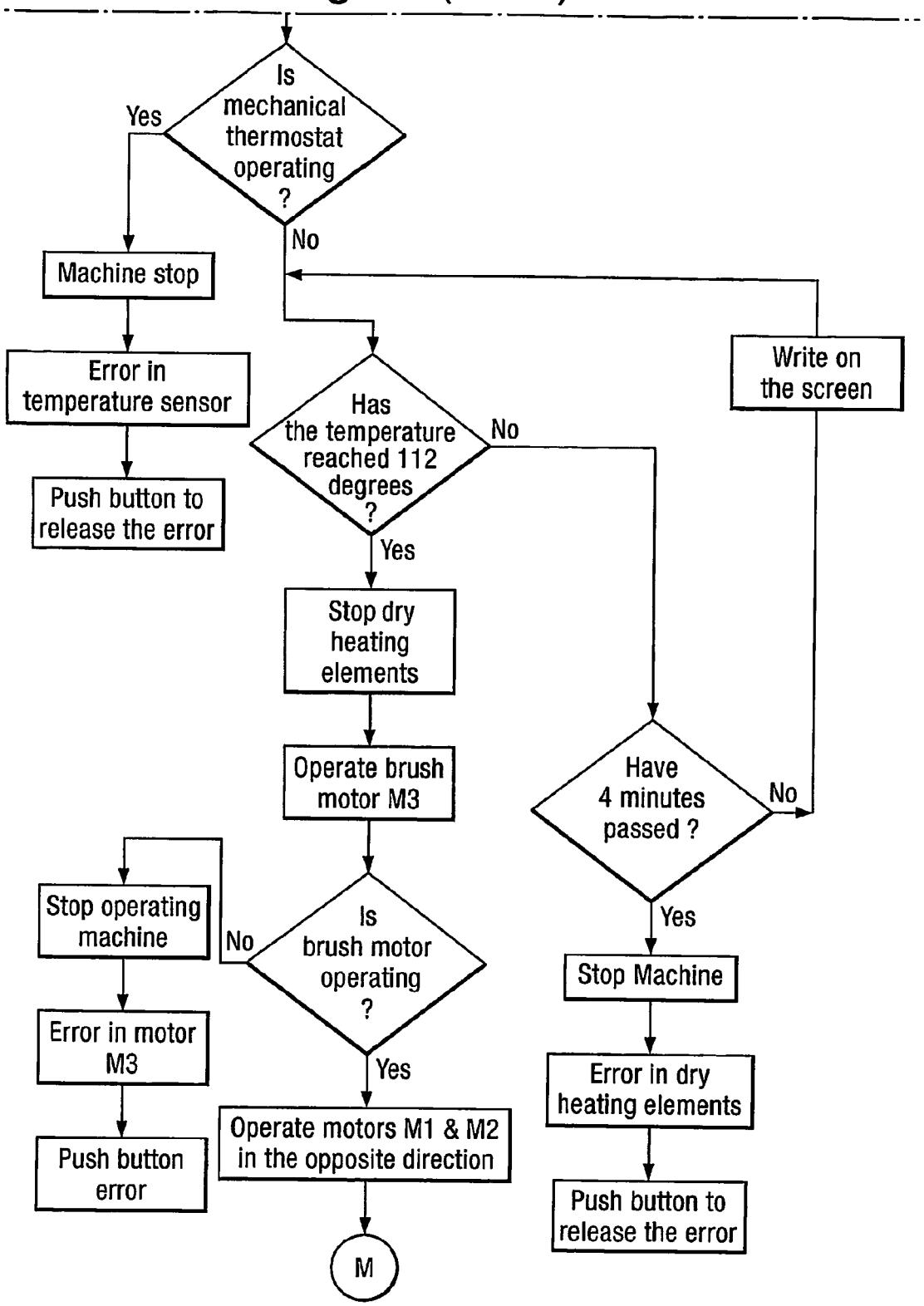
Figure 8G:
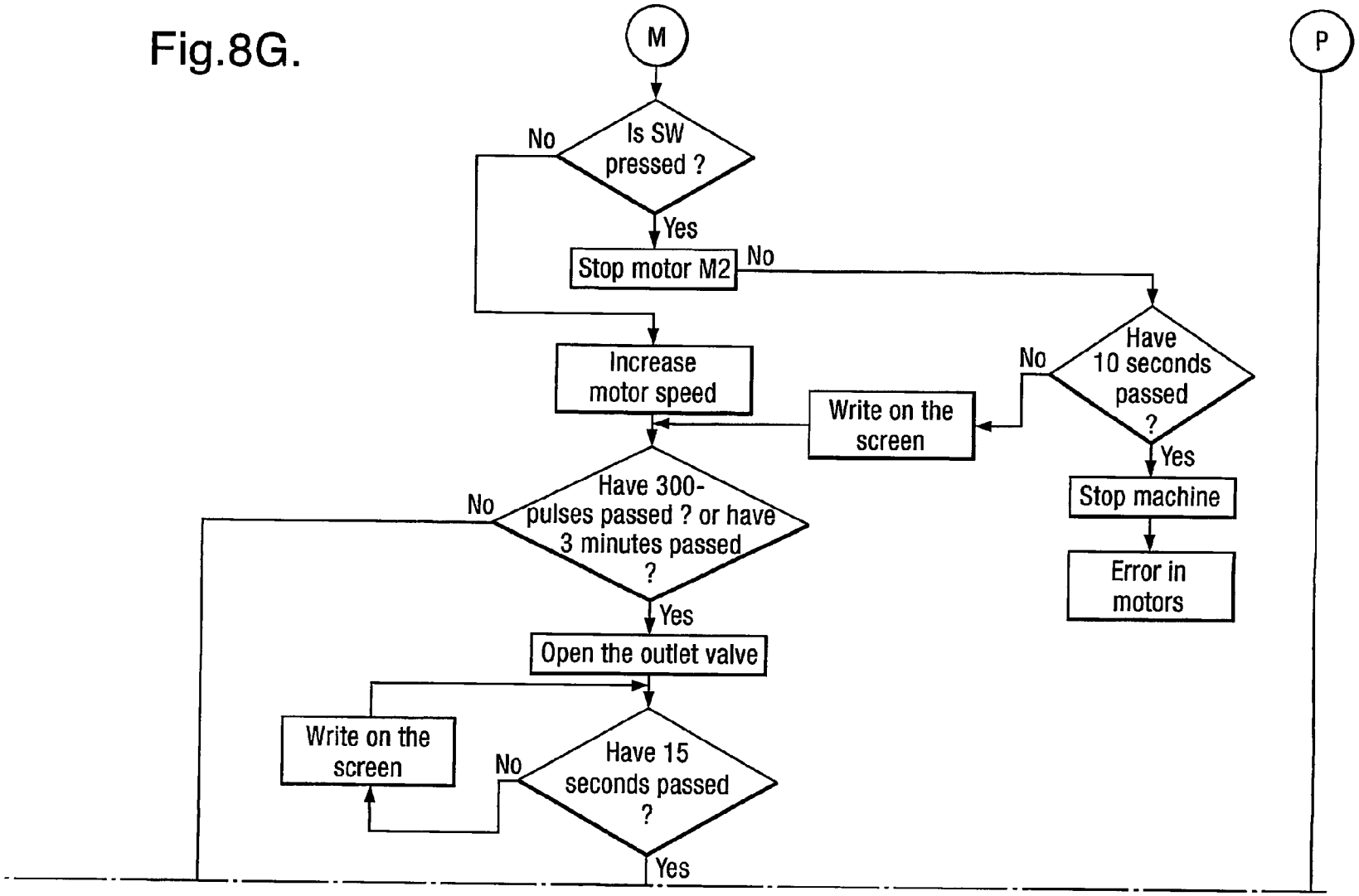
Figure 8G:
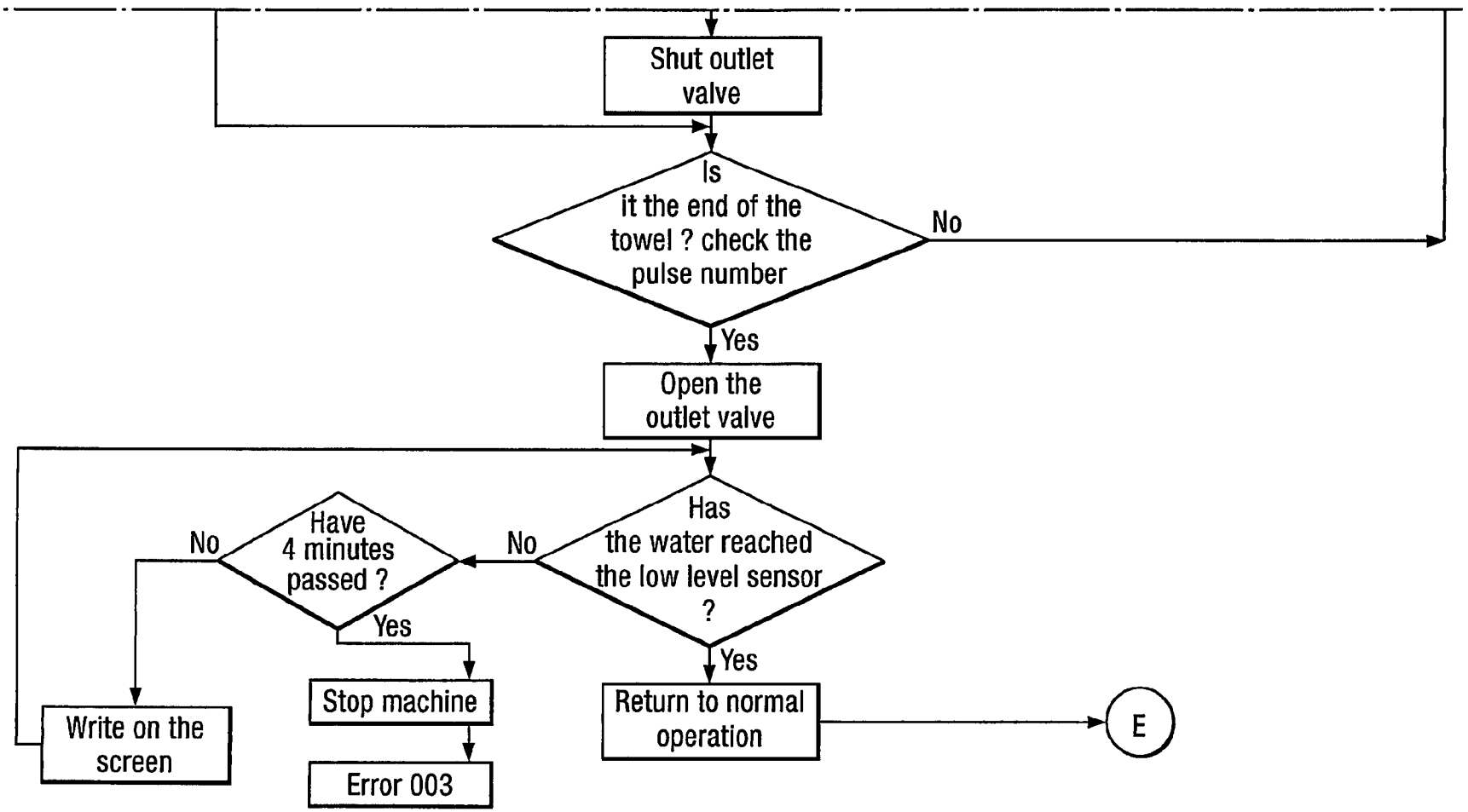

When now the entire towel, or a predetermined portion thereof has been used, or at a preset time during the day or night, there is initiated a reverse procedure of towel cleaning. At the first stage, the bath 35 is emptied, advantageously by gravitation, from the mixture of the detergent and water through the electrically activatable valve 46 (FIG. 5). The bath 35 is then refilled by fresh water through the valve 34 and the heating element 48 (FIG. 6), located at the bottom of the bath 35 and advantageously covered by a perforating and filtering plate 50, is activated. When the water reaches a preset temperature, the heating element 48 is switched off and the heating elements 52 (FIG. 7) of the two contacting drying drums 54, 54' are switched on to heat the drums 54, 54' to a preset temperature, controlled by the temperature sensor 56. As shown, as the drums 54, 54' reach the preset temperatures, they are caused to rotate in two opposite senses by means of a suitable arrangement of belts 58, 58' and pulleys 60, 60', 60". Preferably, the drums 54, 54' are furnished with anti-slipping strips 62, 62', so as to assure that the towel is properly traversed in between the two drums for even drying of both of its surfaces. In this phase of operation, the towel moves from roller 4 to be taken up by roller 6, after passing again in the bath 35 for rinsing, and then through the drums 54, 54' for drying purposes. In order to assure effective rinsing and drying; the speed of advancement of the towel from roller 4 to roller 6, is much slower than the speed of advancement through the bath 35 during the soaking and washing phase.

Several measures have to be taken to maintain the towel in its taut state at all times, especially during movement from one roller to the other in both directions. In addition to the above-described measure and as seen in FIG. 1, there is provided a rod 64 extending across the width of the towel along roller 6, which rod is coupled to a boundary switch 66. When the towel is moved upwards to expose a clean section for use, a soaked and washed section is taken up by roller 6. Upon the clean towel section becoming taut, it presses against the rod 64 which, in turn, presses against the switch 66, to stop the operation of the motor. In the washing and rinsing stage when the switch is activated, the motor of roller 6 ceases to operate and, vice-versa, when the switch is deactivated, the motor commences operation. In this manner, the towel is kept taut with respect to roller 6. Simultaneously therewith the motor activating the rotation of the brushes 22, 22' is caused to operate so that the movement of the towel is positively guided throughout its travelling distance, keeping the towel taut at all times.

The electronic control 68 (FIG. 5) is responsible for the timely selective operation of each of the machine's components detailed above, as preprogrammed to suit different requirements and mode of operation.

A preferred method of operation illustrating details of the machine's working steps and capabilities is shown in FIGS. 8A to 8G. Based on the above description and the details included in the flow diagrams, it is believed that no further explanations are necessary.

While the preferred embodiment shows a pair of brushes 20, 20' for washing the soiled towel section, it should be understood that other washing means could just as well be used, e.g., agitators, ultrasonic liquid vibrators, liquid jets, or the like.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A towel presenting, washing and drying machine, comprising:

a used towel roller and a clean towel roller spaced-apart from each other and each rotatable in a clockwise and counter-clockwise direction;

a bath having liquid inlet and outlet ports located between said rollers supporting a plurality of rod members for guiding a towel section in a meandering fashion in the bath;

means for cleaning the towel section in said bath;

at least one drying drum disposed outside said bath between said rollers;

at least one motor and transmission means coupled to said rollers and the drying drum, and a controller for timely selectively operating each of said rollers and the drying drum, the controller being configured so that successive soiled sections of the towel are soaked and washed in an initial soaking and washing stage and a plurality of soiled sections of the towel are rinsed and dried in a subsequent rinsing and drying stage that is time independent of the soaking and washing stage.

2. The machine as claimed in claim 1, wherein said means for cleaning the towel is at least one pair of cleaning brushes rotatable inside said bath and said transmission means is coupled to said brushes.

3. The machine as claimed in claim 1, further comprising towel tensioning means for maintaining the towel tensioned during rotation of said rollers.

4. The machine as claimed in claim 1, wherein the towel passes between said brushes and said brushes rotate in opposite direction to each other.

5. The machine as claimed in claim 1, wherein the towel passes between said drying drums and said drying drums rotate in opposite direction to each other.

6. The machine as claimed in claim 1, further comprising a heater located inside said bath.

7. The machine as claimed in claim 1, further comprising a replenishable detergent container in liquid communication with said bath.

8. The machine as claimed in claim 1, wherein said inlet and outlet ports are fitted with electrically actuatable valves, controllable by said controller.

9. The machine as claimed in claim 1, wherein said bath further comprises liquid level sensors.

10. The machine as claimed in claim 1, further comprising towel section length dispensing control associated with one of said rollers.

11. A method for automatically presenting a clean towel section for drying purposes and for washing and drying soiled towel sections in a towel presenting and washing machine, comprising;

providing a towel dispenser having first and second rotatable rollers being a used towel roller and a clean towel roller spaced-apart from each other, and a washing chamber;

presenting a user with a towel section by rolling said section off said first roller by rotation in a first direction;

transferring said section after use to said washing chamber containing cleaning liquid to be soaked and washed by the cleaning liquid;

transferring said soaked section to said second roller by rotating it in a first direction;

emptying said washing chamber from cleaning liquid and filling in rinsing liquid;

selectively rotating said second roller in an opposite direction to said first direction for rinsing said towel section in the washing chamber, and drying said washed and rinsed towel section while rolling it up on said second roller for further use.

12. The method as claimed in claim 11, wherein said rinsing and drying operation is effected at a selected hour of day or night.

13. The method as claimed in claim 11, wherein the speed of rotation of the rollers during rinsing and drying is lower than the speed of rotation during soaking and washing.

14. The method as claimed in claim 11, wherein said washing chamber is connected to a water and detergent source and a predetermined amount of liquid and detergent is selectively automatically introduced into the chamber.

15. The method as claimed in claim 11, wherein the washing chamber is emptied before rinsing and drying operations commence.

16. The method as claimed in claim 11, wherein said washing is effected by means of two oppositely rotatable brushes.

17. The method as claimed in claim 11, wherein said drying is effected by means of two oppositely rotatable drying drums.

18. The system according to claim 1, wherein the controller is configured to:

during the washing stage:

fill the bath with water and detergent; and rotate the rollers in a first direction to feed successive sections of soiled toweling through the bath for washing and for collecting the successive sections of soiled toweling after washing on the used towel roller; and during the rinsing stage:

empty the bath of dirty water;

fill the bath with clean water; and rotate the rollers in a second direction opposite to the first direction to remove the toweling from the used towel roller and feed the toweling through the bath for rinsing and subsequent drying.

* * * * *